US007988375B2

(12) United States Patent
Piller

(10) Patent No.: US 7,988,375 B2
(45) Date of Patent: Aug. 2, 2011

(54) TOOTH- AND GINGIVA-CLEANING CONSTRUCTION OPERATING WITH CARBON DIOXIDE ORIGINATING IN SITU

(76) Inventor: István Piller, Szilvásvárad (HU)

( * ) Notice: Subject to any disclaimer, the term of this patent is extended or adjusted under 35 U.S.C. 154(b) by 86 days.

(21) Appl. No.: 12/443,124

(22) PCT Filed: Dec. 15, 2006

(86) PCT No.: PCT/HU2006/000112

§ 371 (c)(1),
(2), (4) Date: Mar. 26, 2009

(87) PCT Pub. No.: WO2008/062239

PCT Pub. Date: May 29, 2008

(65) Prior Publication Data

US 2010/0104352 A1 Apr. 29, 2010

(30) Foreign Application Priority Data

Nov. 21, 2006 (HU) ..... 0600862

(51) Int. Cl.
*A46B 11/00* (2006.01)

(52) U.S. Cl. ..... 401/123

(58) Field of Classification Search ..... 401/268, 401/196, 203, 207, 282, 283, 284, 291, 176, 401/119; 15/167.1

See application file for complete search history.

(56) References Cited

U.S. PATENT DOCUMENTS

| | | | | | |
|---|---|---|---|---|---|
| 2,377,837 | A | * | 6/1945 | Zimmermann | 401/176 |
| 2,524,412 | A | | 10/1950 | Sam | |
| 3,589,823 | A | * | 6/1971 | Hendrickson | 401/176 |
| 5,088,850 | A | * | 2/1992 | Taichman et al. | 401/176 |
| 5,403,105 | A | * | 4/1995 | Jameson | 401/45 |
| 5,855,871 | A | * | 1/1999 | Masters et al. | 424/49 |
| 5,865,195 | A | | 2/1999 | Carter | |

(Continued)

FOREIGN PATENT DOCUMENTS

DE 19753362 6/1999

(Continued)

OTHER PUBLICATIONS

Written Opinion of International Application No. PCT/HU2006/000112, mailed on Jan. 8, 2007.

(Continued)

*Primary Examiner* — David J. Walczak
*Assistant Examiner* — Jennifer Chiang
(74) *Attorney, Agent, or Firm* — Hershkovitz & Associates, LLC; Abraham Hershkovitz

(57) ABSTRACT

The invention relates to a tooth- and gingiva-cleaning construction which functions by the use of carbon dioxide; the construction consists of a tooth- and gingival-cleaning tool as well as of a container tool ordered to the cleaning tool at least before the application and fitting to the cleaning tool. Typical character of the construction is that the headpiece is divided into two elastic chambers which are separated from each other with a water- and gas-impermeable separating wall, and the individual chambers each has filling opening through which the different tooth-paste ingredients can be filled from the two container compartments of the container tool, and on both chambers each a slit can be found firstly near to the separating wall, through the slits the dentifrice content of the two chambers can flow out by the help of pressure.

7 Claims, 2 Drawing Sheets

U.S. PATENT DOCUMENTS

Figure 1:
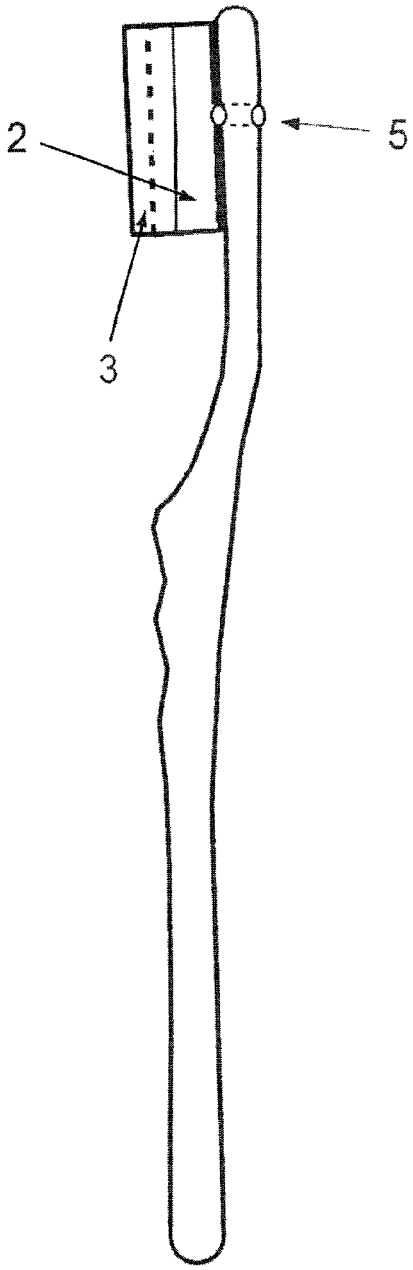

| | | | | |
|---|---|---|---|---|
| 6,331,088 | B2 * | 12/2001 | Owens | 401/282 |
| 6,397,859 | B1 * | 6/2002 | Byrd | 132/308 |
| 6,762,337 | B2 | 7/2004 | Boukanov | |
| 2008/0014010 | A1 * | 1/2008 | Bartschi et al. | 401/146 |

FOREIGN PATENT DOCUMENTS

| | | |
|---|---|---|
| DE | 19959120 | 6/2001 |
| EP | 1639913 | 3/2006 |
| GB | 368423 | 3/1932 |
| GB | 2216419 | 10/1989 |
| JP | 10279453 | 10/1998 |
| WO | 88/10110 | 12/1988 |
| WO | 2005/110149 | 11/2005 |

OTHER PUBLICATIONS

International Search Report of International Application No. PCT/HU2006/000112, mailed Jan. 8, 2007.

* cited by examiner

TOOTH- AND GINGIVA-CLEANING CONSTRUCTION OPERATING WITH CARBON DIOXIDE ORIGINATING IN SITU

The invention relates to a tooth- and gingiva-cleaning construction which develops a vibration motion by the help of the in situ originating carbon dioxide gas in a perforated, from outside roughened membrane which is directly connected with the set of teeth and forms a cleaning tool. One of the parts of the invention is the container tool, too.

The suitable cleaning of the oral cavity and within it firstly the teeth and the gingiva is a problem equal in age with the humanity since the failure of the oral hygiene can be accompanied with pain and suffering as well as with digestive anomalies. The cleaning of the intertooth space (gaps), however, is an especially difficult and unresolved problem till now. Ten thousands of patents deal with the development of tooth-brushes and tooth-cleaning techniques. Besides of the improved tools of the usual mechanical friction (brushing) it can be found the employments of other physical and chemical tools, too, e.g. (but not limited to) ultrasonic treatment, electrical vibrations, micro brushes, water under pressure, pulsating impulses, dissolved ozone, special gap cleaners, and the like.

The solution of the present invention bases on the use of carbon dioxide gas. Numerous forms of the use of the carbon dioxide exist in the therapy the basis of which is first of all the vasodilator effect of the carbon dioxide known for centuries and also scientifically justified. This therapy was earlier employed first of all in thermal baths, later on, however, a lot of private, domestic carbon dioxide bath were worked up to cause the vasodilator effect. The vasodilator effect of the carbon dioxide can be effective e.g. (but not limited to) in the following forms:

- bath in water enriched with carbon dioxide;
- staying in a room containing carbon dioxide gas ("mofette" effect);
- direct topical intake of the carbon dioxide gas through the skin; and
- injection of carbon dioxide gas intravenously (insufflation).

The carbon dioxide, however, is employed in the therapy not only because of its vasodilator effect but this gas also can supply pressure, where it is therapeutically necessary; e.g. grave wounds can be placed under carbon dioxide pressure by the use of a pillow. The role of the carbon dioxide here is to press the wound tightly but nevertheless mercifully to avoid the loss of blood. The carbon dioxide originates from an outer source (US 2003/01139696).

Whatever solution should be in question the quality of the carbon dioxide used has a significant effect to the applicability and the price. The quality of the carbon dioxide—maybe with the exception of the natural carbon dioxide sources of the thermal baths—can give a trouble everywhere. Only that carbon dioxide mixture is suitable for therapeutic aim which is pure (pyrogenetic-free) and its carbon dioxide content is at least 96%. The industrial carbon dioxides don't meet these requirements, which fact significantly increases the costs of the treatment, why the cleaning requires an expensive process. This is the explanation of the significant difference in the prices between the carbon dioxide gas suitable for medical aim and the industrial carbon dioxide gas.

As we have mentioned earlier the carbon dioxide gas used should be pharmaceutically suitable from the point of view of the purity. It can be reached not only by cleaning the carbon dioxide gas but according to another solution it is possible to form the carbon dioxide from cleaned (optionally sterilized) basic materials first of all on the scene of the employment. For this it is necessary that the reactants of a simple carbon dioxide developing reaction should be present separating from each other, and by the help of a performed manipulation these separated reactants combined with each other form carbon dioxide. The reactants of the simplest reaction developing carbon dioxide are the carbonates or hydrogen carbonates and (weak) acids, respectively, and the procedure performed can be any physical joining being able to start the reaction. The already activating chemical reaction is maintained by the continuously releasing water on the basis of the following reaction:

$$CO_3^{--}+2H^+ \rightarrow CO_2+H_2O$$

Such a physical procedure for starting the reaction, e.g. at the effervescent tablets (powders, granules) the solving of the dry mixture in water, where the reactants separated in dry condition join with each other while dissolving. Further, such a physical procedure is the joining the reactants from two elastic containers first of all by pressure where the reactants staying separately in the two containers are being pressed out and develop carbon dioxide.

The nature of the reactants to be found in the foam-forming mixture is not too essential from the point of view of the invention; it is important only that at the joining of the reactants and the water carbon dioxide of suitable amount should be formed. As a matter of fact the point of views of the selection are really the same as in the case of effervescent tablets, powders or granules based on similar reaction, that is the formed ions should not be caustic, toxic or bad-tasting (rather should be good to the taste, respectively, although it is guaranteed by the toothpaste). Of course, from the point of view of the selection the economic point of views are very significant, too. Quite like as at the effervescent (sparkling) tablets, powders or granules the combination of citric acid and sodium hydrogen carbonate can be considered as an excellent combination. Instead of citric acid among others succinic acid, malic acid or ascorbic acid are suitable, too. As a carbonate developing carbon dioxide above all the calcium carbonate comes into question from the point of view of costs but among others sodium carbonate, sodium hydrogen carbonate, potassium carbonate, potassium hydrogen carbonate or magnesium carbonate are suitable, too. At the selection of the ingredients it is unconditionally necessary to take into consideration that the ingredient should be passed through a filling opening and an extrusive opening.

In this application an invention is in question according to which the carbon dioxide originates in the scene i.e. in the oral cavity, and the carbon dioxide developed has a double role. Its primary role is to supply pressure to a membrane which comes into vibration and increases the cleaning effect of the toothpaste. Its only secondary but not completely negligible role is the physiological vasodilator effect displayed to the mucous membrane, which is, however, is of too short period to display stronger effect. The refreshing, cooling effect of the carbon dioxide asserts itself in the oral cavity, too, which is advantageous compared to the traditional tooth-cleanings.

The technical literature knows numerous solutions according to which the carbon dioxide displays some pharmaceutical effect in the mouth. Among them, however, it can be found only a few solution where the reaction developing carbon dioxide happens in the oral cavity itself. These solutions constitute the prior art for this invention. According to the patent document GB368423 over and above the active ingredients gas-developing compositions are incorporated into water-free gelatine, including succinic acid and sodium hydrogen carbonate, which, joining in suitable manner, develop carbon dioxide. As far as the arrival at a particular place the components are separated from each other in the gelatine, and the joining happens at the admission into the body cavity (prominently mentioning the oral cavity) by melting the gelatine.

According to PCT document WO88101110 the active ingredient of a dentifrice preparation is stannic(II) fluoride but it also contains grinding- and filling materials as well as a material mixture developing carbon dioxide under suitable circumstances. A paste develops mixing it with the saliva, and carbon dioxide develops, too, which helps by means of its mechanical effect in that the stannic(II) fluoride and the grinding material should get at the surface of teeth. The preparation can be swallowed after use.

In Japanese patent document JP127551 such acid and base are mixed together in solid state which develop carbon dioxide under the influence of humidity in the oral cavity. The further ingredients of the mixture are the different additives and surface-active agents (detergents). This preparation is suitable for cleaning and disinfecting the oral cavity including teeth and gingiva, and for refreshing the breath. In all this the developing carbon dioxide has a significant role.

In Japanese patent document JP10279453 it can be found a composition which is able to remove the fur and plaque from the surface of teeth and is able to prevent the deterioration and the illnesses of the teeth. The composition of the tooth-powder preparation is the following:

A. a kind of carbonate or hydrogen carbonate,

B. a kind of weak acid, first of all organic acid,

C. a kind of surface-active agent (detergent), and optionally

D. a kind of a wearing (grinding) material.

This composition effectively disperses the formulated preparations, e.g. pharmaceutical compositions under the effect of humidity by the help of the carbon dioxide developing in the oral cavity.

It can be laid down as a fact that the aim of the solutions being obtainable in the said documents is similar, their implementations have similar elements, too, but the solution according to this invention is well separable from them which will be demonstrated by the detailed description of the invention. The aim of our invention is the elimination of the insufficiencies of the solutions belonging to the prior art.

The essence of the solution according to the invention at the tooth- and gingiva-cleaning construction is a cleaning tool reminding of tooth-brush and playing the role of a tooth-brush on the headpiece of which there are no bristles; plastic- or rubber membrane substitute for the bristles.

In this construction the container tool can be any tool which is suitable for occasionally filling up the two chambers of the headpiece of the cleaning tool divided into several parts, preferably two parts. Whatever container containing a kind of dentifrice, expediently toothpaste, consists of two container compartments as contrasted with the traditional toothpaste tubes, where in one of the container compartments some kind of carbonate or hydrogen carbonate, in another container compartment some kind of weak acid can be found.

The other further ingredients of the toothpaste can be found in the same container compartments; that which in what is decided by the technology and the compatibility of the materials. It is imaginable such a solution that in both container compartments each a toothpaste can be found with the same composition, the only difference is in the ingredients supplying the acid and the carbonate, respectively. This container tool has two outgoing openings from which the two components can be filled into the chamber being obtainable in the headpiece of the cleaning tool. This two-piece container tool according to one of the preferable executive form of the invention is a rigid-walled container, so called roll container provided with a piston but any container tool can be suitable which is able to fulfil the abovementioned task.

The headpiece of the tooth- and gingiva-cleaning tool reminding of tooth-brush is supplied lengthwise with a separation wall and thus is divided into two chambers. The toothpaste ingredient arrives from the chambers at the cleaning instrument through slit each. An about 3 mm thick cleaning instrument which is a soft, perforated, spongy-structured rubber equipment, substitutes for the traditional brushes in this cleaning tool. The rubber part of the cleaning instrument connected with the teeth has a from outside roughened surface. The perforation plays a double role: the toothpaste goes through it from the container part of the tooth-cleaning tool to the surface, at the same time the developing carbon dioxide gas causes resonance in the rubber body in that way that the overpressured gas pass through the elastic-structured material. The carbon dioxide gas takes the toothpaste along and squeezes it into the gaps among teeth, in this manner such a "turbo" cleaning effect can be reached which raises this solution among the best solutions though it uses only simple tools. The resonance is responsible to the mechanical cleaning effect.

During the tooth-cleaning it is possible to bring pressure to the elastic wall of the chambers of the cleaning tool, in this manner the two reacting components are pressed into (under) the surface of the from outer roughened, elastic, spongy-structured rubber membrane behaving as resonator and substituting brushes and forming cleaning instrument.

Thus, the carbon dioxide has first of all a resonance-stimulating and pressing effect among teeth. Because of the littleness of the staying period the physiological, vasodilator and refreshing effect of the carbon dioxide displayed to the mucous membrane is only a secondary but not negligible effect. The leaving carbon dioxide gives a cooling impression in the oral cavity which is similar to the impression of a mineral water saturated with carbon dioxide.

A lot of variations of the solutions according to the invention are possible and we don't wish to limit our invention to one or another of the preferable executive forms. Consequently a lot of different solutions can exist for the execution of the construction. Examining the individual parts of the construction we make known a practical, advantageous solution each. The scope of the invention is determined most commonly by claim 1, and the executive examples are determined by the dependent claims.

Figure 2:
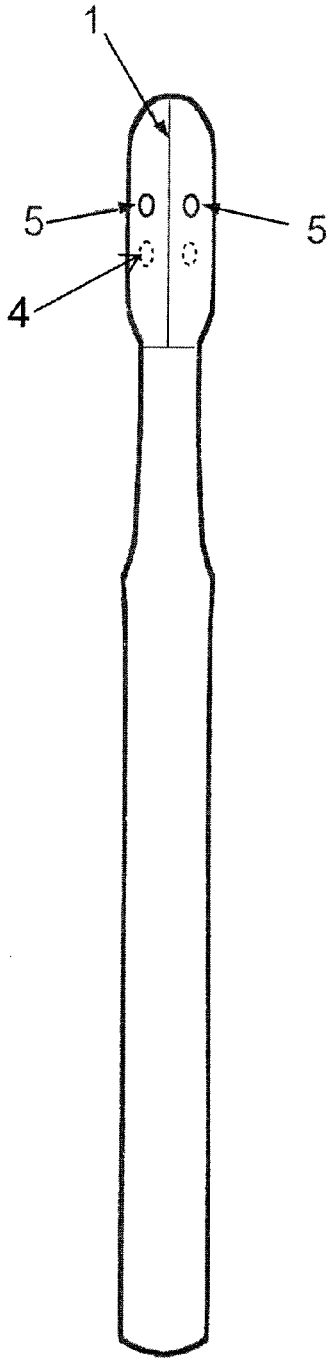

FIG. 1. and FIG. 2. shows one of the advantageous forms of the tooth- and gingiva-cleaning tool of the construction according to the invention.

The tool can be seen in FIG. 1. in side-view, in FIG. 2. in bottom-view.

Figure 3:
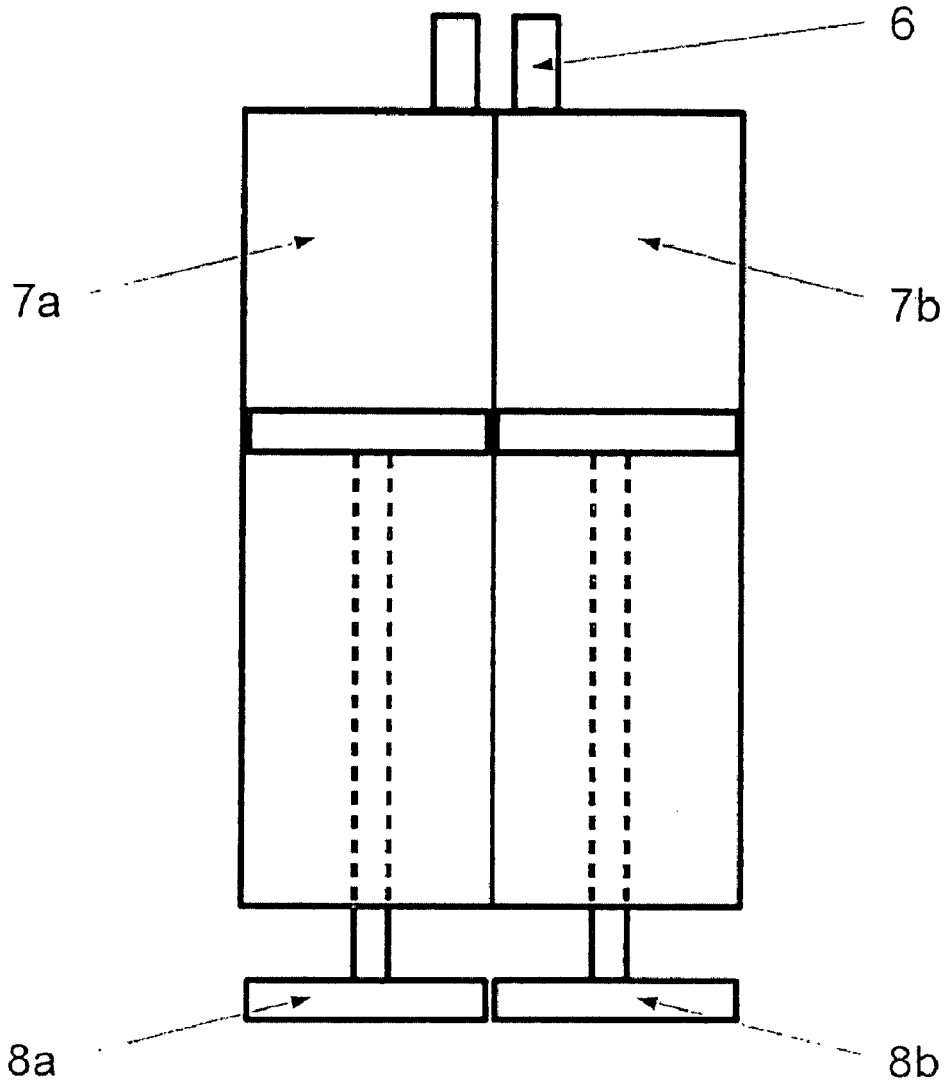

FIG. 3. is the sketch of the container tool.

1 is the separation wall foil between the two refillable 2 chambers. The 3 cleaning instrument is a from outside roughened, perforated, spongy rubber layer. 4 slits can be found between 2 chambers and 3 cleaning instrument for passing on the ingredients. The slits can be located in the top wall of each of the two chambers and located adjacent to the separation wall. The 5 filling openings serve to the admission of the materials of the container tool into the 2 chambers. Though our invention is not limited to the executing form presented in FIG. 1. and FIG. 2., this form is, nevertheless, the most suitable as far as both the handle and headpiece are concerned, but the tooth-brushes have a form shaping up by the everyday practice. It does not constitute the subject-matter of the invention, what is the dimension of the headpiece, what is the length of the handle and what is the scale-relation between the headpiece and the handle.

FIG. 3. introduces one of the possible forms of the container tool of the construction according to invention. The container tool containing the toothpaste is a rigid-walled container, so-called roll container, being composed from two 7*a*, 7*b* container compartments and supplied with two 8*a*, 8*b* dosing instruments, preferably piston, where in the container compartments the one and another components, respectively, can be found, and on which the two 6 filling instruments are suitable for that aim that one or another component, respectively, should be filled in from here into the chambers of the headpiece of the cleaning tool through 5 filling openings. Containers of such type are available in trade.

The construction according to the invention and within it the tooth- and gingiva-cleaning tool and container tool function in such manner that the two different toothpaste ingredients filled in the two 7*a*, 7*b* container compartments of the preferably rigid-walled container tool occasionally will be filled through the 5 filling openings into the two separated 2 chambers of the headpiece of the tooth- and gingiva-cleaning tool by the help of two 8*a*, 8*b* dosing instruments preferably pistons, and by the employment of the two 6 filling instruments, and the headpiece will be pressed fitting the tool to the teeth. The elastic-walled 2 chambers of the headpiece empty their contents into or behind, respectively, the elastic rubber body, constituting the 3 cleaning instrument, through 4 slits being obtainable in the vicinity of the separation wall. The two ingredients of the toothpaste combine here, carbon dioxide forms from the acid and the carbonate which makes the membrane of 3 cleaning instrument vibrate, and the toothpaste as well as the carbon dioxide leave across the perforations of the 3 cleaning instrument. The vibration of the membrane of the 3 cleaning instrument presses the tooth-paste between the teeth while the carbon dioxide has vasodilator effect for a short time to the gingiva and a refreshing effect in the oral cavity. The cleaning of the instrument and its headpiece can be performed in fresh water by repeated kneading.

A lot of different solutions of the execution of the construction can exist. Examining certain parts of the construction it is worthy to call the attention to the following solutions. As we have mentioned earlier the shape and the size of the cleaning tool itself remind of the traditional tooth-brush. As a 3 cleaning instrument about 3 mm thick, soft, perforated, spongy, from outside roughened rubber membrane equipment substitutes for traditional bristles, the meaning of the rubber being understand wider, i.e. including here the plastic membranes, too, which are able to fulfil this role.

The composition of the dentifrice itself is not significant from the point of view of the invention except from the (weak) acid and carbonate; a toothpaste of whatever composition which is suitable for cleaning the tooth can be carried up onto the teeth by the help of the said construction, and the subject-matter of the invention is not the composition of the toothpaste. From the point of view of the invention it is essential only that the components of the toothpaste finally should combine by mixing the contents of the container compartments where one of the compartments contains certain (weak) acid and another compartment contains certain carbonate or hydrogen carbonate.

The headpiece of the tooth- and gingiva-cleaning tool in question is divided into two elastic-walled 2 chambers impermeable for gases and humidity. The material of the elastic-walled chambers can be any plastic impermeable for gases and humidity, but from the point of view of both price and suitability the polyalkylene plastics as polyethylene or polypropylene are preferred.

The dimension and the arrangement of the different pipes and openings can be critical. It is advantageous that the toothpaste ingredients (charges) to be combined get into the spongy material not on the full surface but through a 4 slit of 2 mm calibre where this 4 slit can be found along the wall separating the two ingredients. In this manner it is possible to guarantee that a perfectly mixed material should appear on the edges of the tooth- and gingiva-cleaning tool, too, which is important first of all because of pH value.

In the course of an advantageous executing example such a construction structure is made which consists of a tooth- and gingiva-cleaning tool and fitting to it of a rigid-walled container tool divided two 7*a*, 7*b* container compartments, where the rigid-walled container tool is a container available in trade divided into two compartments, which has 6 filling instrument each for outgoing the different toothpaste ingredients being obtainable in the two 7*a*, 7*b* container compartments and for forwarding them into the tooth- and gingiva-cleaning tool, as well as has dosing instrument preferably piston each. The composition of the two different tooth-pastes is practically the same, e.g. Aquatest Herbal toothpaste (Glaxo Smith-Klyne) but in addition to the toothpaste in one of the 7*a*, 7*b* container compartments 10% sodium hydrogen carbonate, in another compartment 5% citric acid can be found. The tooth- and gingiva-cleaning tool itself consists of a handle of 18 cm in length and of a headpiece 3 cm×1.2 cm×1.6 cm of size, within it the headpiece is divided into two elastic 2 chambers, which consist of polypropylene foil and are separated from each other with 1 separating wall made from water- and gas-impermeable polypropylene. On both 2 chambers 4 slits of 2 mm size can be found near to the 1 separating wall through which the contents of the two 2 chambers can flow out on the influence of a manual pressure. Both 2 chambers have 5 filling opening each through which the different toothpaste ingredients can be filled from the said two-part container tool through the 6 filling instrument.

The headpiece of the tooth- and gingiva-cleaning tool is covered with an elastic, soft, perforated, spongy-structured, from outside roughened, 3 mm wide rubber membrane equipment, which equipment comes into vibration by the help of the developing carbon dioxide, and through perforations of which the tooth-paste and the carbon dioxide flow out. The advantage of this invention is that by the help of which a bristle-free, tooth-protecting, at the same time effective ""turbo tooth-brush" can be established.

The invention claimed is:

1. A tooth- and gingiva-cleaning construction with the use of carbon dioxide, the construction comprising:

a tooth- and gingiva-cleaning tool; and a container tool fitting to the tooth- and gingiva-cleaning tool, the container tool being configured to store dentifrices, wherein the tooth- and gingiva-cleaning tool comprises:

a handle and a headpiece, the headpiece being divided into two elastic chambers being separated from each other with a water- and gas-impermeable separating wall, each of the two elastic chambers having a filling opening suitable for filling in the dentifrices;

at least one slit located in a top wall of each of the two elastic chambers and located adjacent to the separating wall, the at least one slit being configured to allow a flow of the dentifrices from the two elastic chambers by pressure; and a cleaning instrument included in the headpiece, the cleaning instrument being covered with an elastic and perforated equipment configured to be vibrated by carbon dioxide generated in the cleaning instrument from a mixture of the flowed dentifrices from the two elastic chambers, the flowed dentifrices and the carbon dioxide flowing out through perforations of the elastic and perforated equipment, and wherein the container tool comprises at least two container compartments, each of the at least two container compartments including a filling instrument configured to insert the dentifrices into the two elastic chambers through the filling opening, at least one of the at least two container compartments including one of a carbonate or hydrogen carbonate, and at least another of the at least two container compartments including a weak acid.

2. The construction according to claim 1, wherein the elastic and perforated equipment comprises one of, a spongy-structured rubber or a plastic membrane equipment.

3. The construction according to claim 2, wherein the chambers are in the headpiece of the cleaning tool, and the separating wall is made from a polyalkylene.

4. The construction according to claim 3, wherein at least one of the at least two container compartments includes sodium hydrogen carbonate in preferably 8-12%, and at least another of the at least two container compartments includes citric acid in preferably 3-7%.

5. The construction according to claim 1, wherein the chambers are in the headpiece of the cleaning tool, and the separating wall is made from a polyalkylene.

6. The construction according to claim 2, wherein at least one of the at least two container compartments includes sodium hydrogen carbonate in preferably 8-12%, and at least another of the at least two container compartments includes citric acid in preferably 3-7%.

7. The construction according to claim 1, wherein at least one of the at least two container compartments includes sodium hydrogen carbonate in preferably 8-12%, and at least another of the at least two container compartments includes citric acid in preferably 3-7%.

* * * * *